United States Patent [19]

Stern

[11] 4,263,502

[45] Apr. 21, 1981

[54] APPARATUS FOR HEATING SKI BOOTS

[75] Inventor: Donald J. Stern, Bellingham, Wash.

[73] Assignee: Allsop Automatic, Inc., Bellingham, Wash.

[21] Appl. No.: 94,824

[22] Filed: Nov. 16, 1979

[51] Int. Cl.[3] ..... H05B 3/06

[52] U.S. Cl. ..... 219/521; 12/120.5; 128/382; 211/35; 36/2.6; 219/211; 219/215; 219/382; 219/536; 219/527; 219/386

[58] Field of Search ..... 219/211, 212, 215, 217, 219/382, 521, 527, 386, 527, 528, 536, 537; 128/256, 379, 382, 383; 36/2.6, 11.5; 12/120.5; 211/34, 35; 224/45 S, 45 T, 45 Z; 34/239

[56] References Cited

U.S. PATENT DOCUMENTS

| | | | |
|---|---|---|---|
| 2,633,846 | 4/1953 | Wray | 128/256 |
| 3,105,891 | 10/1963 | Gibbard et al. | 219/215 X |
| 3,210,787 | 10/1965 | Allsop | 12/120.5 |
| 3,534,391 | 10/1970 | Bauer | 219/211 |
| 3,663,796 | 5/1972 | Hines et al. | 219/211 |
| 3,721,373 | 3/1973 | Penniman | 224/45 S X |
| 3,729,760 | 5/1973 | Allsop | 12/120.5 |
| 3,766,361 | 10/1973 | Swingar et al. | 219/521 |
| 3,909,718 | 9/1975 | Allsop et al. | 224/45 S |
| 4,113,159 | 9/1978 | Allsop | 224/45 S |
| 4,145,602 | 3/1979 | Lee | 219/270 |

*Primary Examiner*—Volodymyr Y. Mayewsky
*Attorney, Agent, or Firm*—Hughes, Barnard & Cassidy

[57] ABSTRACT

Methods and apparatus are disclosed for externally and conductively heating at least a portion of the sole of a ski boot and for convectively heating substantially the entire inner surface of the ski boot while the ski boot is firmly, but removably, clamped against a flat surface with the flat sole of the ski boot in extensive surface-to-surface contact therewith so as to permit drying of wet boots, warming of cold boots, and/or softening of the molded foam interiors of the boots, to render such boots more comfortable while maintaining the flat sole of the ski boot rigidly clamped in a flat planar condition to prevent warpage thereof. In a preferred form of the invention, methods and apparatus are disclosed for externally and radiantly heating at least a portion of the sole of each of a pair of ski boots removably carried by, and clamped to, a boot and shoe tree and for simultaneously convectively heating the inner surfaces of both ski boots.

8 Claims, 5 Drawing Figures

APPARATUS FOR HEATING SKI BOOTS

BACKGROUND OF THE INVENTION

The present invention relates generally to improved methods and apparatus for heating ski boots so as to permit drying of wet boots, warming of cold boots, and/or softening of the molded foam interiors of such boots so as to improve the comfort thereof when such boots are donned; and, more particularly, to improved methods and apparatus for heating ski boots while such boots are firmly, yet removably, clamped with their flat soles in surface-to-surface contact with a relatively flat surface so as to prevent warpage of the ski boot during the heating and/or drying process. In a preferred embodiment, the present invention relates to improved methods and apparatus for clamping such ski boots to a vertical surface with the soles of the boots vertically oriented—such, for example, as the orientation inherent when such boots are mounted in a boot and shoe tree of the type disclosed in I. J. Allsop U.S. Pat. No. 3,210,787 assigned to the assignee of the present invention—and for externally and conductively heating at least the lowermost portions of the vertically oriented flat soles of the boots so as to generate convective air currents within the interior portions of the ski boots which serve to convectively heat substantially the entire inner surfaces of the ski boots.

In recent years there has been a tremendous increase in public interest in participative athletic events such, for example, as skiing. Such increased interest has been reflected in an ever increasing number of people who desire to participate in a wide range of skiing activities such, merely by way of example, as downhill skiing, cross country skiing, and ski jumping. These various activities are commonly carried on on both a competitive and a non-competitive basis, as well as on a professional and amateur basis.

Along with the increased interest and participation in such activities has come a rising awareness and concern by both the public and the manufacturers of skiing equipment, as well as by the operators of skiing facilities, of the physical dangers inherent in virtually all types of skiing activities. Consequently, manufacturers have significantly upgraded the quality of ski equipment, with particular attention having been directed to automatic release bindings and improved ski boots, in an effort (i) to minimize the danger of injury resulting from accidental falls and the like, and (ii) to maintain rising interest levels in participative skiing activities. As a result of these efforts, today ski boots tend to be rather sophisticated products made of high-quality materials and designed to both minimize the risk of physical injury and to improve the comfort and the wearability of such boots. This, of course, has resulted in the manufacture of ski boots which represent a relatively significant investment on the part of the purchaser, with such boots commonly ranging from sixty dollars ($60.00) to one hundred and fifty dollars ($150.00) per pair and, often, considerably higher.

As the standard of living has increased, more and more skiing facilities have been opened and, consequently, an ever increasing number of people have had both the economic means and the opportunity to participate in skiing activities. Such individuals have tended to demand that ski equipment purchased be of high quality and employ the latest safety and comfort features available. Thus, today it is common to find that most skiers—whether amateur or professional, and whether beginner, intermediate or skilled—own or rent high-quality ski equipment; particularly high-quality ski boots and bindings. Such ski boots represent a significant investment for both the individual owner and for the operator of ski facilities who is engaged, inter alia, in the rental of ski boots. Because of this investment, it is important that suitable provisions be made for insuring that the ski boots are maintained in the best possible condition at all times so as to (i) increase the expected life of this quality product, and (ii) to insure that the ski boot remains in peak condition compatible with the design criteria for boot and binding combinations which is necessary to meet high safety standards.

Inherently, the very nature of skiing activities results in subjecting ski equipment—particularly ski boots—to a wide range of environmental changes in terms of both temperature and moisture content resulting from melting snow and/or foot perspiration within the boot. Therefore, failure to exercise care in the maintenance and preservation of such boots can significantly shorten boot life and can also deleteriously affect the desired safety features of the boot. Consequently, it is important the owner of such boots take appropriate steps to both store ski boots and to dry wet boots and/or warm cold boots under controlled conditions which insure that the boots are not subjected to warpage—an undesirable condition that not only affects the safety factor when attempting to use a warped boot in a specially designed, quality, quick-release ski binding, but, moreover, also results in damage to the boot uppers and to the molded foam boot interiors, thereby affecting both the wearer's comfort and the life expectancy of the boot. And, of course, it will be appreciated that the wearer's comfort is, in and of itself, an important safety consideration since skiers who are not properly outfitted in comfortable ski boots are more likely to be prone to accident than those who are comfortably and properly outfitted.

With the foregoing considerations in mind, numerous efforts have been made to design ski equipment which will enhance both the life expectancy of ski boots and the safety features that are designed therein. Today, a large proportion of the owners of relatively expensive ski boots also own suitable boot and shoe trees which serve to maintain the ski boots in a fixed, desired condition of flexure during periods of nonuse. For example, most ski boots today are designed with relatively thick flat soles, and with relatively thin uppers often surrounding a foamed thermoplastic inner which is commonly molded to conform to the shape of the wearer's foot. It is, therefore, important that the ski boot be maintained in this state, particularly during periods of nonuse and/or storage when warpage can result as conditions of temperature and moisture content change. Thus, most commercially available boot and shoe trees and designed so that the flat bottom surfaces of the boot soles are firmly, yet removably, clamped in a flat planar condition during periods of nonuse and/or storage, thereby insuring that the boot does not warp as temperature and moisture conditions change. Typical of such boot and shoe trees is that disclosed in the aforesaid I. J. Allsop U.S. Pat. No. 3,210,787 which is commonly sold under the trademark BOOT-IN®, a registered trademark of Allsop Automatic, Inc., of Bellingham, Washington.

Moreover, since skiers will commonly wish to remove their ski boots for short periods of time—for example, between separate morning, afternoon and/or evening skiing activities, or overnight—it is important that suitable provisions be made available for heating such boots during short periods of nonuse so as to quickly dry wet boots, warm cold boots, and/or warm the molded thermoplastic interiors of such boots so as to soften the foam interiors and thereby increase the comfort characteristics of the boots when the boots are again donned. Many types of heating equipment have been designed over the years in an effort to meet this need both in connection with conventional shoes and/or boots and, in some instances, specifically in connection with ski boots. One early drier system suitable for use with conventional shoes and boots is described in Lund U.S. Pat. No. 1,318,780 where the boot is simply placed on a heated platform which may be either flat or shaped to conform to the normal curvature of the boot or shoe sole. In either case, no provision is made for preventing warpage of the boot or shoe and, consequently, the very drying process tends to promote warpage.

Additionally, numerous types of devices have been developed for insertion into the boot or shoe for promoting drying thereof. Typical devices include those described in Doyle U.S. Pat. No. 1,543,828, Lessard U.S. Pat. No. 1,733,611, Yentis U.S. Pat. No. 2,098,735, Bosse U.S. Pat. No. 3,632,963, and Riley U.S. Pat. No. 3,867,611. Again, the flexible nature of the devices described in these patents is such that the drying process tends to promote warpage of the boot or shoe.

More recently, a ski boot and glove warmer has been disclosed in Lee U.S. Pat. No. 4,145,602 wherein a coin operated apparatus is provided for blowing hot air into the interior foot area of the boot for a predetermined period of time. Again, the arrangement is such that the very drying process employed tends to promote warpage of the ski boot.

SUMMARY OF THE INVENTION

Accordingly, it is a general aim of the present invention to provide improved methods and apparatus for warming and/or drying ski boots which overcome all of the foregoing disadvantages inherent in conventional prior art driers and which permit of rapid controlled warming and/or drying of ski boots while the latter are firmly, yet removably clamped in a fixed position with the flat sole portion of the boot maintained in a flat plane.

It is a more specific object of the invention to provide improved methods and apparatus of the foregoing character which are convenient to use, economical, and which may be readily incorporated in conventional portable boot and shoe trees without any significant increase in cost, expensive design changes, and/or increase in weight and/or complexity of the boot and shoe tree, so that the same apparatus can be used to carry the boots to and from the ski area, as well as dry the boots when the boots are being stored, for example, overnight.

In one of its more detailed aspects, it is an objective of the invention to provide improved methods and apparatus for heating and/or drying ski boots wherein the heat produced is concentrated in the area of the relatively thick sole portion of the ski boot which is normally the most difficult area to heat and/or dry rapidly; and, in attaining this objective, provision is made for conductively and externally heating the sole portion of a ski boot.

An ancillary objective of the invention is the provision of improved methods and apparatus wherein conductive heat is applied externally to the lower sole portion of a ski boot mounted in a boot and shoe tree with the sole oriented in a vertical plane so as to induce convective air currents interiorly of the boot which serve to gently heat and/or dry substantially the entire inner surface of the ski boot.

A further detailed objective of the invention is the provision of an improved system for drying and/or warming ski boots wherein maximum conductive heat transfer is concentrated in the area of the toe of the ski boot, the area which tends to be most critical in terms of the wearer's comfort and commonly the area of the boot which tends to accumulate the highest moisture levels, and for convectively heating the other surfaces of the boot interior.

DESCRIPTION OF THE DRAWINGS

These and other objects and advantages of the present invention will become more readily apparent upon reading the following detailed description and upon reference to the accompanying drawings, in which.

Figure 1:
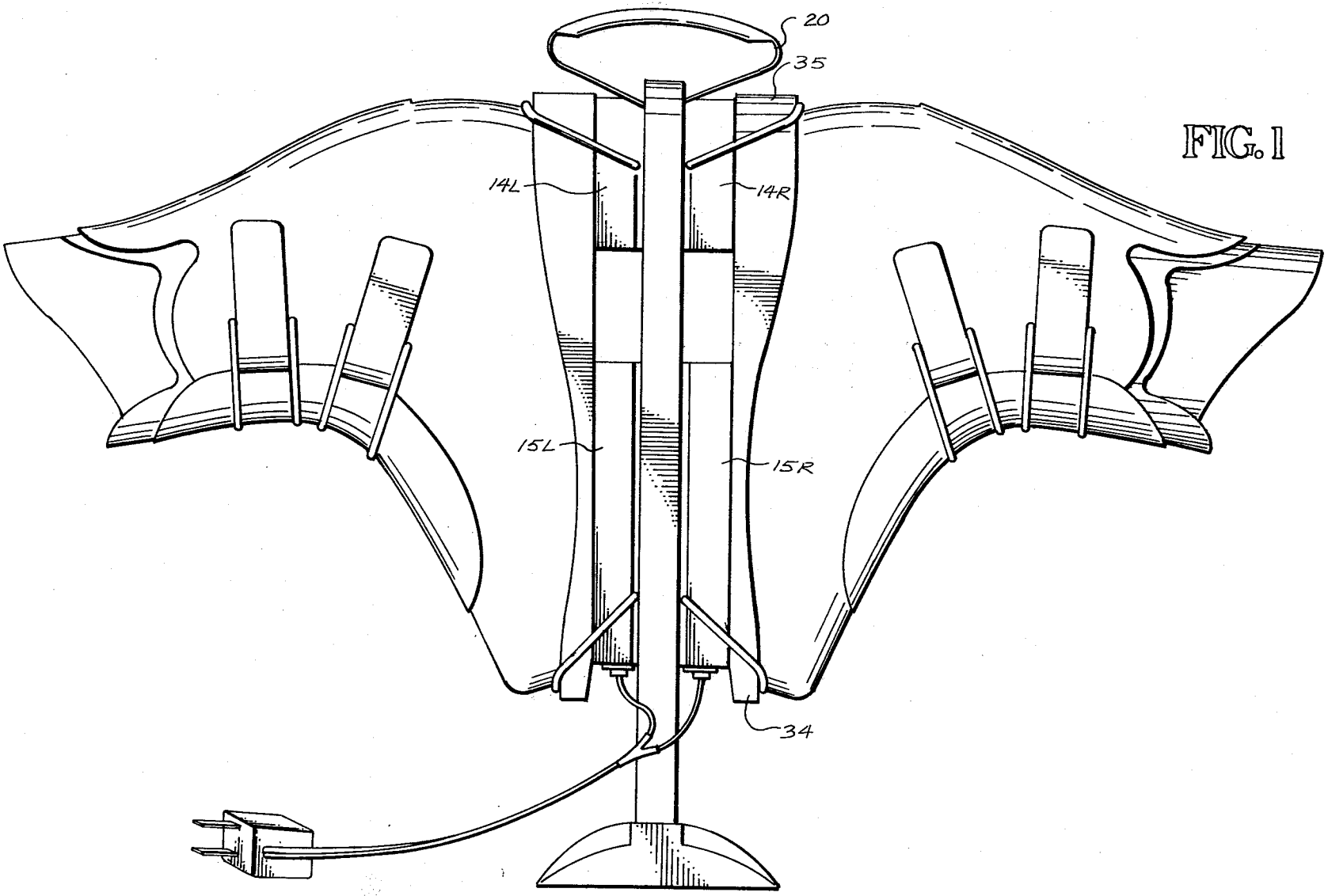
FIG. 1 is a side elevational view, here illustrating a boot and shoe tree embodying features of the present invention with a pair of ski boots mounted thereon and with the boots oriented with their flat soles lying in parallel vertical planes with the toe portions of the boots extending vertically downward and the heel portions of the boots extending vertically upward.

While the invention is susceptible of various modifications and alternative forms, specific embodiments thereof have been shown by way of example in the drawings and will herein be described in detail. It should be understood, however, that it is not intended to limit the invention to the particular forms disclosed but, on the contrary, the intention is to cover all modifications, equivalents and alternatives falling within the spirit and scope of the invention as expressed in the appended claims.

DETAILED DESCRIPTION

The Environment of the Invention

Briefly, and as best illustrated in FIG. 1, the present invention finds particularly advantageous use in connection with a boot and shoe tree of the type generally illustrated at 10 in FIG. 1, and as disclosed and claimed in greater detail in the aforesaid I. J. Allsop U.S. Pat. No. 3,210,787. Thus, as here shown, the exemplary boot and shoe tree 10 includes: a base member 11 suitable for standing the tree on a floor or other generally flat surface; vertically upstanding support means 12 rigidly and permanently secured to the base member 11 in any suitable fashion (not shown); a pair of spaced, parallel, vertically extending left and right heel plates 14L, 14R and a pair of spaced, parallel, vertically extending left and right toe plates 15L, 15R mounted on opposite sides of the upstanding support means 12 for supporting a pair of ski boots 16L, 16R; heel retainer means 18L, 18R respectively carried by the heel plates 14L, 14R; toe retainer means 19L, 19R respectively carried by the toe plates 15L, 15R; and, a bail-like handle 20 secured to the upper end of the vertically upstanding support means 12 for ease of carrying the boot and shoe tree 10.

The arrangement is such that the heel and toe plates 14L, 15L are co-planar and define a first vertically extending planar surface which permits the flat bottom surface of the sole 21L of ski boot 16L to engage the lefthand heel and toe plates 14L, 15L over a wide expanse of surface area of the sole 21L and with extensive surface-to-surface contact between the sole 21L and both the heel and toe plates, while the lefthand heel and toe retainers 18L, 19L as viewed in the drawings overlie the extending heel and toe portions, respectively, of the ski boot sole 21L and serve to firmly clamp the boot 16L to the tree 10 with the ski boot sole 21L retained in a generally flat planar condition. Similarly, the righthand heel and toe plates 14R, 15R as viewed in the drawings are also co-planar and define a second vertically extending planar surface which permits the flat bottom surface of the sole 21R of ski boot 16R to engage the righthand heel and toe plates 14R, 15R in the same fashion as described above with respect to the lefthand boot 16L and heel and toe plates 14L, 15L.

Figures 2, 3:
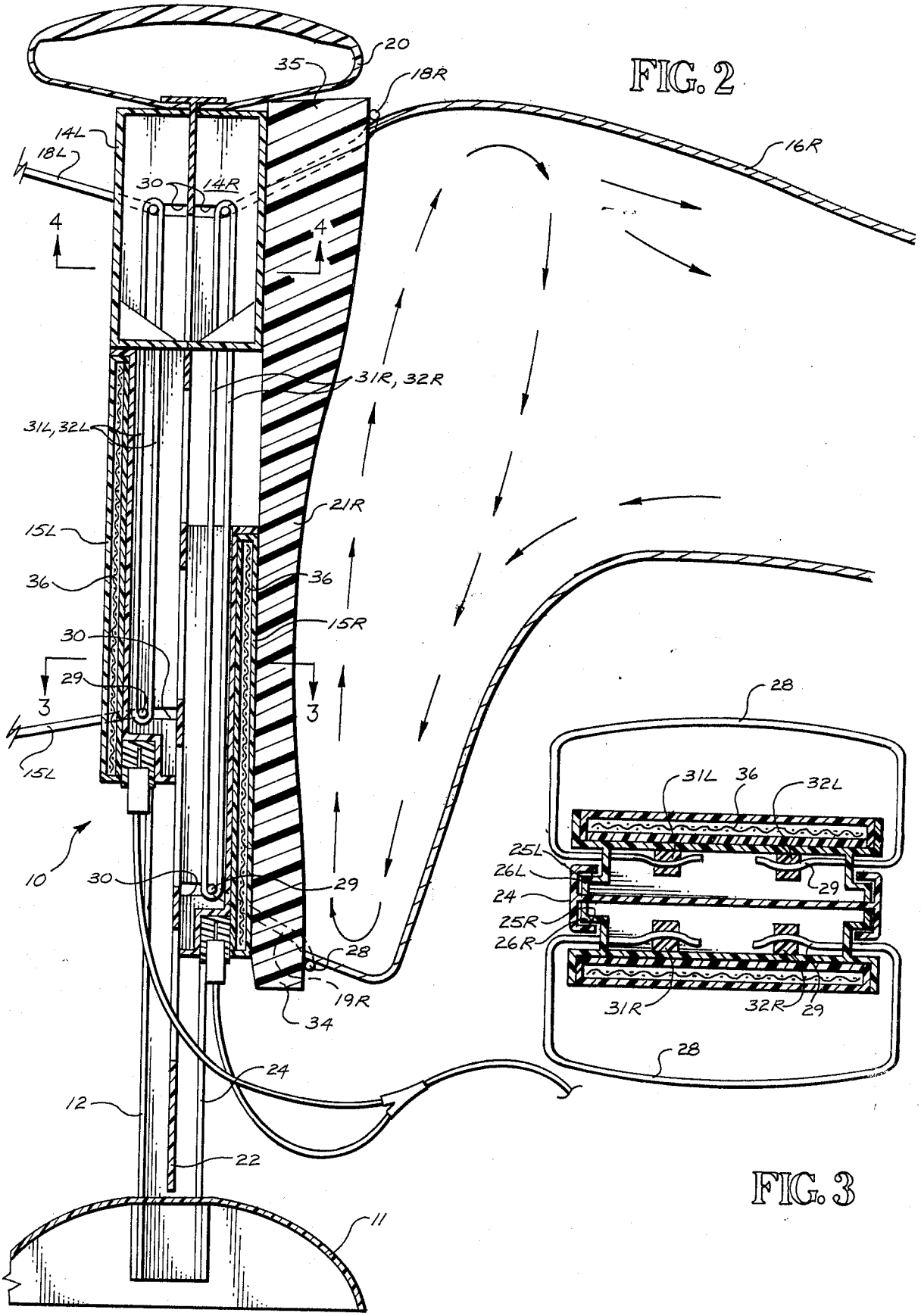
FIG. 2 is an enlarged vertical sectional view of the boot and shoe tree shown in FIG. 1 with one ski boot removed so as to illustrate the mode of operation of the boot and shoe tree, and with the other boot shown in vertical section so as to diagrammatically illustrate the convective air currents which are generated within the interior portion of the boot and which serve to heat and/or dry the inner surfaces of the boot.
FIG. 3 is a sectional view taken substantially along the line 3—3 in FIG. 2 and illustrating in particular the structural relationship between the toe plates of the exemplary boot and shoe tree and the vertical support member and which permits of sliding movement of the toe plates along the support member.

In order to permit the boot and shoe tree 10 to readily accommodate a wide variety of boot sizes, the toe plates 15L, 15R are preferably mounted on the vertically upstanding support means 12 with freedom for slideable movement along the support means and towards and away from the heel plates 14L, 14R. To accomplish this, the vertically upstanding support means (which may be fabricated from suitable sheet metal or molded from any suitable plastic material) is preferably formed with a central web portion 22 and a pair of integral channel-shaped side members 24 defining a pair of left tracks 25L and a pair of right tracks 25R. As best illustrated in FIG. 3, the toe plates 15L, 15R are respectively provided with pairs of laterally projecting flange portions 26L, 26R which are respectively received within the pairs of tracks 25L, 25R and which serve to securely retain toe plates 15L, 15R on the boot and shoe tree 10, yet which permit vertical movement of the toe plates as the flanges 26L, 26R slide vertically within the confining tracks 25L, 25R, respectively.

Figure 4:
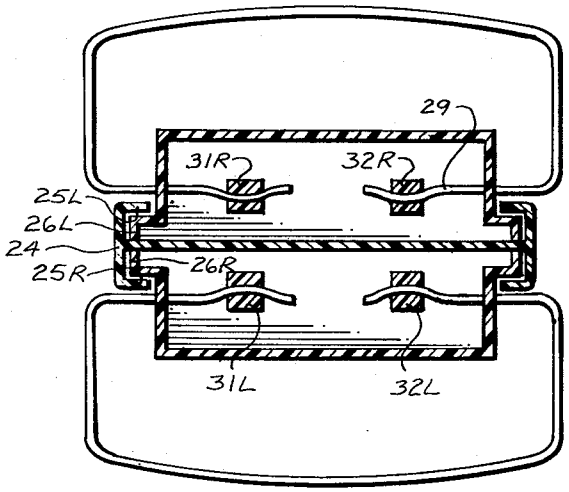
FIG. 4 is a sectional view taken substantially along the line 4—4 in FIG. 2; and, FIG. 5 is a vertical sectional view similar to FIG. 2, but here illustrating a modified embodiment of the invention wherein the ski boots, only one of which is shown in FIG. 5, are mounted with the flat sole portions of the boots disposed in parallel vertical planes with the heel portions of the boots extending vertically downwardly and the toe portions of the boots extending vertically upwardly, thereby tending to improve the stability of the boot and shoe tree.

In order to insure that the ski boots, irrespective of size, are firmly retained on the tree 10 with the boot soles clamped in a planar condition, provision is made for normally biasing the heel and toe plates 14L, 14R and 15L, 15R towards one another. To accomplish this, and as best illustrated by reference to FIGS. 3 and 4 conjointly, the heel and toe retainers 18L, 18R and 19L, 19R take the form of generally C-shaped metal elements formed of steel or other suitable material and having an outer relatively flat portion 28 adapted to fit over the projecting heel and/or toe ends of the sole on a ski boot, and a pair of reversely bent end portions 29 which pass inwardly through slots 30 formed in the side edges of the heel and toe plates 14L, 14R and 15L, 15R. Resilient means, which may take the form of suitable spring-like members (not shown) or a first pair of suitable elastic bands 31R, 32R are respectively engaged at one end with the two end portions 29 of the toe retainer 19R (FIGS. 2 and 3) and at the other end with the two end portions 29 of the heel retainer 18R (FIGS. 2 and 4) and serve to normally bias the toe plate 15R upwardly within tracks 25R until the heel and toe plates 14R, 15R are in engagement. Similarly, a second pair of elastic bands 31L, 32L serve to normally bias the toe plate 15L upwardly in track 25L until the heel and toe plates 14L, 15L are in engagement.

In usage it is simply necessary for the user to place the sole of a ski boot on the toe plate—e.g., the sole 21R of boot 16R is placed on plate 15R—and to insert the projecting toe portion 34 of the sole under the relatively flat outer portion 28 of the toe retainer 19R, and then press downwardly against the bias provided by elastic bands 31R, 32R, causing the toe plate 15R to move downwardly in tracks 25R. The heel portion of the sole is then placed flat against heel plate 14R, and the outer relatively flat portion 28 of heel retainer 18R is positioned over the projecting heel portion 35 of the boot's sole 21R, thus firmly clamping the boot 16R to the tree 10 with the sole 21R in extensive surface-to-surface contact with both the toe plate 15R and the heel plate 14R. It has been found that the foregoing arrangement wherein the elastic bands are engaged directly with the free ends 29 of the heel and toe retainers 18L, 18R and 19L, 19R provides the additional advantage of causing the relatively flat portions 28 of the heel and toe retainers to extend outwardly from the plane of the heel and toe plates into their generally operative positions as shown in FIG. 1, thereby facilitating proper placement of ski boots on the tree 10.

Ski Boot Heating and/or Drying In Accordance With The Present Invention

In accordance with one of the important aspects of the present invention, provision is made for externally and radiantly heating at least a portion of the ski boot sole while the boot is firmly, yet removeably, clamped to the vertical surface defined, for example, by the heel and toe plates of a boot and shoe tree 10 so as to radiantly heat at least a portion of the boot sole and so as to generate convective air currents within the boot interior which tend to convectively heat substantially the entire inner surface of the boot, thereby warming and/or drying the boot while it is firmly clamped with the boot's sole in a planar condition. In the preferred form of the invention, this is accomplished by positioning heating means within the toe plates 15L, 15R of the tree 10 so that at least the toe portion of the ski boot's sole is subjected to conductive heat while carried by, and clamped to, the tree 10, thereby conductively heating the toe portion of the sole and warming and/or drying such portion. To this end, the present invention contemplates positioning any suitable heating means such, for example, as electrical resistance elements 36 (FIG. 2) within the toe plates 15L, 15R and extending substantially the full length and across the full width of the toe plates. The resistance elements 36 are electrically coupled to a conventional outlet plug 38 which may be plugged into any suitable source of electricity such as a conventional electrical outlet box (not shown). Thus, when plug 38 is plugged into a suitable source of electricity, the electrical resistance elements 36 serve to heat the toe plates 15L, 15R which are maintained in extensive surface-to-surface contact with the toe portions of the ski boot soles 21L, 21R, thereby conductively heating the latter.

As heat is conductively transferred to and through the sole of the ski boot, the air within the toe portion of the ski boot is rapidly heated and begins to rise, thereby generating convective air currents within the boot as indicated by the arrows 39 in FIG. 2. As a result, virtually the entire inner surface of each ski boot is convectively heated so as to warm and/or dry the boots in a manner that is effective, efficient and rapid, yet wherein the boots are precluded from warping during the heating and/or drying process because they are firmly clamped to the boot tree 10 with the soles maintained in a planar condition.

It will, of course, be apparent that because the sole portions of the boot soles 21L, 21R are confined in relatively extensive surface-to-surface contact with the toe plates 15L, 15R, the transmission of conductive heat energy is highly effective and efficient, and relatively little heat loss occurs. Moreover, in the preferred form of the invention shown in FIGS. 1–4, the most concentrated area of heat transfer is in the toe portion of the ski boot, the very area where moisture accumulations are most significant and most likely to cause discomfort to the wearer and damage to the boot. The balance of the boot including, for example, the molded foamed plastic interior, the relatively thin uppers, and the heel portion of the boot are subjected to convective heating which, although providing a lesser degree of heat transfer per unit of time, is more than adequate for warming and/or drying these portions of the ski boot.

Figure 5:
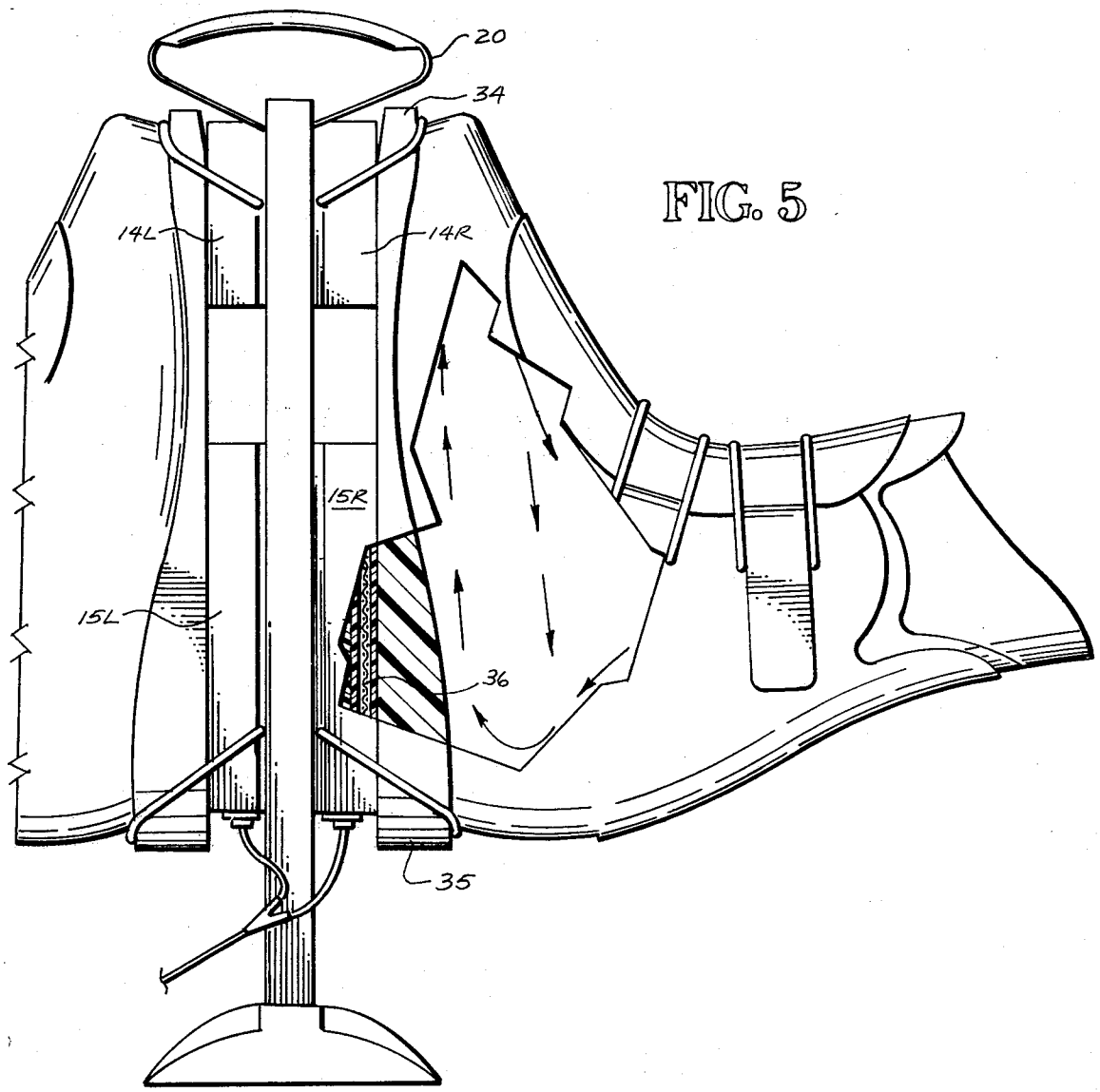

Turning to FIG. 5, there has been illustrated a slightly modified form of the invention wherein the heel plates 14L, 14R are mounted beneath the toe plates 15L, 15R and are slideably mounted on the upright vertical support means 12 in the same manner as previously described in connection with the toe plates of FIGS. 2 and 3. Thus, in this arrangement the ski boots are mounted with the heels extended downwardly and the toes extending vertically upward. The heel plates 14L, 14R are preferably heated in the same manner as previously described in connection with the toe plates of FIG. 2, thereby conductively heating the heel portions of the boot and generating convective air currents as indicated by the arrows 40 which tend to convectively heat the balance of the ski boots. This form of the invention has the advantage that the boot and shoe tree 10 tends to be somewhat more stable when boots are mounted thereon. However, in this form of the invention the most effective area of heat transfer is the heel portion of the boot, whereas it is generally the toe portion of the boot where the greatest heat transfer is required. Nevertheless, this form of the invention will tend to effectively and efficiently warm and/or dry ski boots, although it is believed that it will take somewhat longer to effect sufficient convective heat transfer as to adequately warm and/or dry the toe portions of the boots.

Those skilled in the art will appreciate the various modifications may be made in the ski boot drying system herein described without departing from the spirit and scope of the invention. For example, it would be possible to utilize suitable hot air, hot water, and/or steam heat generating means in lieu of the electrical heating system here described, particularly in those instances where the vertical heating surfaces are mounted in a wall or other structural member and wherein one desires to warm and/or dry a large number of boots simultaneously. However, when dealing with individual pairs of boots, it has been found to be most practical to utilize electrical heating means in connection with individual boot and shoe trees. Moreover, while the invention has theretofore been described in connection with conductively heating only the lowermost portions of the ski boots—e.g., the toe portions of the boots as shown in FIG. 2 or the heel portion of the boots as shown in FIG. 5—it would also be possible to conductively heat virtually the entire sole of the ski boot by the simple expedient of placing heating elements in both the toe and heel plates. Such an arrangement is generally not believed to be necessary, particularly in the form of the invention shown in FIG. 2, but would have some advantages in connection with the form of the invention shown in FIG. 5 since it would enable more rapid heating of the toe portion of the boot.

What is claimed is:

1. In a boot and shoe tree of the type suitable for storing ski boots and having a base member, support means mounted on said base member and extending vertically upward therefrom, means defining a vertically extending planar toe plate mounted on said support means, means defining a vertically extending planar heel plate mounted on said support means in the same plane as the plane of said planar toe plate defining means, at least one of said toe plate defining means and said heel plate defining means being mounted on said support means with freedom for slideable movement along said support means so as to permit relative movement of said toe plate defining means and said heel plate defining means towards and away from one another, resilient means for normally biasing said toe plate defining means and said heel plate defining means towards one another, toe retainer means mounted on said toe plate defining means for engaging the toe portion of the flat sole of a ski boot and removably clamping the toe portion of the flat sole of the ski boot flat against said toe plate defining means, and heel retainer means mounted on said heel plate defining means for engaging the heel portion of the flat sole of a ski boot and removeably clamping the heel portion of the flat sole of the ski boot flat against said heel plate defining means, whereby the flat sole of the ski boot is firmly and removeably clamped to said co-planar toe and heel plate defining means in abutting engaged surface-to-surface contact therewith for storage in a flat planar condition;

the improvement comprising: heating means mounted in at least one of said toe plate and heel plate defining means for conductively heating the flat portion of the sole of the ski boot which is in surface-to-surface contact with the heated one(s) of said toe plate and heel plate defining means across the entire abutting and engaged surface of the flat sole portion of the ski boot which is in contact with the heated one(s) of said toe plate and heel plate defining means so as to uniformly and conductively heat the abutting and engaged surface of the flat sole of the ski boot and so as to generate the convective air currents within the interior of the ski boot for convectively heating the entire inner surface of the ski boot while firmly maintaining the flat sole of the ski boot clamped in a flat plane so as to prevent warpage thereof.

2. The improvement as set forth in claim 1 further characterized in that said vertically extending toe plate defining means is mounted on said support means beneath said vertically extending heel plate defining means, and said heating means is mounted in said toe plate defining means so as to conductively heat the toe portion of the flat sole of the ski boot and so as to generate convective air currents within the interior of the ski boot and thereby convectively heat the entire inner surface of the ski boot.

3. The improvement as set forth in claim 1 further characterized in that said vertically extending heel plate defining means is mounted on said support means beneath said vertically extending toe plate defining means, and said heating means is mounted in said heel plate defining means so as to conductively heat the heel portion of the flat sole of the ski boot and so as to generate convective air currents within the interior of the ski boot and thereby convectively heat the entire inner surface of the ski boot.

4. The improvement as set forth in claim 1 further characterized in that said heating means comprises electrical resistance elements mounted in at least the lowermost one of said toe plate and heel plate defining means.

5. In a boot and shoe tree of the type suitable for storing ski boots and having a base member, support means mounted on said base member and extending vertically upwardly therefrom, means defining a pair of parallel vertically extending planar toe plates respectively mounted on opposite sides of said support means, means defining a pair of parallel vertically extending planar heel plates respectively mounted on opposite sides of said support means with said heel plates respectively lying in the same planes as the planes of said parallel toe plates so as to define a pair of parallel vertically extending surfaces mounted on opposite sides of said support means with each surface defined by one of said toe plates and one of said heel plates, at least one of said toe plates and said heel plates in each of said parallel vertically extending surfaces being mounted on said support means with freedom for slideable movement along said support means so as to permit relative movement of said toe plates and said heel plates towards and away from one another in the planes of said pair of parallel vertically extending surfaces, resilient means for normally biasing said toe plates and said heel plates in each of said parallel vertically extending surfaces towards one another, toe retainer means mounted on each of said toe plates for respectively engaging the toe portions of the flat soles of a pair of ski boots and removeably clamping the toe portions of the flat soles of the ski boots flat against respective ones of said toe plates, and heel retainer means on each of said heel plates for respectively engaging the heel portions of the flat soles of a pair of ski boots and removeably clamping the heel portions of the flat soles of the ski boots flat against respective ones of said heel plates, whereby the flat sole of each ski boot is firmly and removeably clamped to said co-planar toe and heel plates defining respective ones of said parallel vertical surfaces in abutting engaged surface-to-surface contact therewith for storing in a flat planar condition;

the improvement comprising: heating means mounted in at least one of said toe plates and heel plates in each of said parallel vertically extending surfaces for conductively heating the flat portion of the sole of each ski boot which is in surface-to-surface contact with the heated one(s) of said toe plates and heel plates across the entire abutting and engaged surface of the flat sole portion of the ski boot which is in contact with the heated one(s) of said toe plates and heel plates so as to uniformly and conductively heat the abutting and engaged surface of the flat sole of each ski boot and so as to generate convective air currents within the interior of each ski boot for convectively heating the entire inner surface of each ski boot while firmly maintaining the flat soles of both ski boots clamped in respective ones of parallel flat planes so as prevent warpage thereof.

6. The improvement as set forth in claim 5 further characterized in that each of said vertically extending toe plates is mounted on said support means beneath a respective one of said vertically extending heel plates, and said heating means is mounted in each of said toe plates so as to conductively heat the toe portion of the flat sole of each ski boot and so as to generate convective air currents within the interior of each ski boot and thereby convectively heat the entire inner surface of each ski boot.

7. The improvement as set forth in claim 5 further characterized in that each of said vertically extending heel plates is mounted on said support means beneath a respective one of said vertically extending toe plates, and said heating means is mounted in each of said heel plates so as to conductively heat the heel portion of the flat sole of each ski boot and so as to generate convective air currents within the interior of each ski boot and thereby convectively heat the entire inner surfaces of each ski boot.

8. The improvement as set forth in claim 5 further characterized in that said heating means comprises electrical resistance elements mounted in at least the lowermost one of said toe plate and said heel plate in each of said vertically extending surfaces.

* * * * *